United States Patent [19]

Theilacker

[11] Patent Number: 4,646,638

[45] Date of Patent: Mar. 3, 1987

[54] LIQUID APPLICATION SYSTEM AND APPARATUS FOR A ROTARY PRINTING MACHINE

[75] Inventor: Klaus Theilacker, Friedberg, Fed. Rep. of Germany

[73] Assignee: Man-Roland Druckmaschinen Aktiengesellschaft, Augsburg, Fed. Rep. of Germany

[21] Appl. No.: 738,663

[22] Filed: May 28, 1985

[30] Foreign Application Priority Data

May 25, 1984 [DE] Fed. Rep. of Germany ..... 3419764

[51] Int. Cl.[4] ..... B41F 31/14; B41F 31/26

[52] U.S. Cl. ..... 101/349; 101/DIG. 14

[58] Field of Search ..... 101/349, 350, 348, DIG. 14, 101/207-210, 148

[56] References Cited

U.S. PATENT DOCUMENTS 3,625,148 12/1971 Muselik ..... 101/348

4,337,699 7/1982 Beisel ..... 101/DIG. 14

*Primary Examiner*—J. Reed Fisher

*Attorney, Agent, or Firm*—Frishauf, Holtz, Goodman & Woodward

[57] ABSTRACT

Drive power for axially oscillating a rider roller (1, 27, 60) is obtained by coupling the rotary movement transferred thereto by frictional engagement with a counter roller (2, 28, 61) to an internal gearing, coupled to a cam - cam follower arrangement over a reduction gearing. The system is particularly suitable for moving fluid film, for example printing ink from an end region of the counter roller, which may be an ink application roller, towards the middle, by use of two jacket portions (4, 5; 30, 31; 63, 64) on the rider roller, which jacket portions come in engagement with the counter roller only when the axially oscillatory movement of the particular jacket portion is from an end portion of the counter roller towards the middle; upon reversal of the stroke of the axially oscillatory movement, the other jacket half, by eccentric offset, then comes into engagement with the counter roller to then, again, move film or liquid from the other end portion towards the center of the counter roller.

11 Claims, 3 Drawing Figures

LIQUID APPLICATION SYSTEM AND APPARATUS FOR A ROTARY PRINTING MACHINE

REFERENCE TO RELATED PUBLICATIONS

German Patent DE No. 31 27 880, Barrois;
German Patent DE No. 31 48 667, Jeschke.

The present invention relates to rotary printing machines, and more particularly to a method, system and apparatus to apply a liquid coating to a roller or cylinder of the printing machine, such as ink, damping fluid and/or ink—damping fluid emulsions. More particularly, the invention relates to a method and apparatus to provide the liquid uniformly over a liquid application roller and to transport the respective liquid—be it ink, damping fluid or emulsions thereof—from edge zones towards the middle of the roller.

BACKGROUND

German Patent 30 14 144 describes an apparatus to move excess ink from the end regions of a roller towards the center thereof, by looping an endless transport belt about an inker roller and over two parallel deflection rollers and guiding the belt over two inclined guide rods. German Patents 31 27 880 and 31 48 667 describe other arrangements, using frusto-conical rotary rollers which are applied against each other and located in V-shaped arrangement, engageable with an inker roller, so that the ink may travel from the outer regions of the roller towards the middle thereof over the conical rollers.

All the arrangements described have a disadvantage, namely that the inclined guidance of engaged elements result in undesirable changes in linear speed of engaged elements along the axis of the inker roller, so that the linear speed at any axial location of the respective engaged rollers at the circumference will not be the same. This difference is due to the inclination of either the belts or of the inclined surfaces of conical elements, which, in the region of engagement or contact between the inclined belts or the conical elements with the cylindrical inker rollers will have different speeds at different axial locations. The inclined ink transport arrangement using belts—as described in German Patent 30 14 144—is, additionally, subject to contamination. The conical-type transport elements permit application only at point engagement on certain axial locations of the inker roller and thus can transport ink only in predetermined and localized regions of the inker roller.

THE INVENTION

It is an object to provide an arrangement in which ink, damping liquid or other fluid can be transported axially along a rotating roller, typically from the end region towards the central portion thereof, and in which the transport is efficient, effective, and differences in speed between engaged elements with the respective liquid-carrying roller are essentially eliminated.

Briefly, a liquid-carrying roller, such as a roller of a damper in an offset printing machine, or an inker in any type of printing machine, is intermittently engaged with respectively eccentrically offset circumferential portions of a liquid transport roller which, additionally, axially oscillates or translates back-and-forth. The rotary speeds and the axially oscillating movement are so matched that, as a portion of the eccentric roller moves towards the center of the liquid—carrying roller, the surfaces are in engagement. Upon the reverse movement, that is, retraction, the previously lifted-off roller section or portion then will come in engagement since, then, the movement of the second portion will be from the other side towards the center.

As a result, the eccentrically, preferably 180° respectively, offset portions of the liquid transport roller push liquid on the liquid-carrying roller from the edge zones towards the center region thereof, intermittently, as the transport roller shifts or oscillates back-and-forth.

DRAWINGS

DETAILED DESCRIPTION

Figure 1:
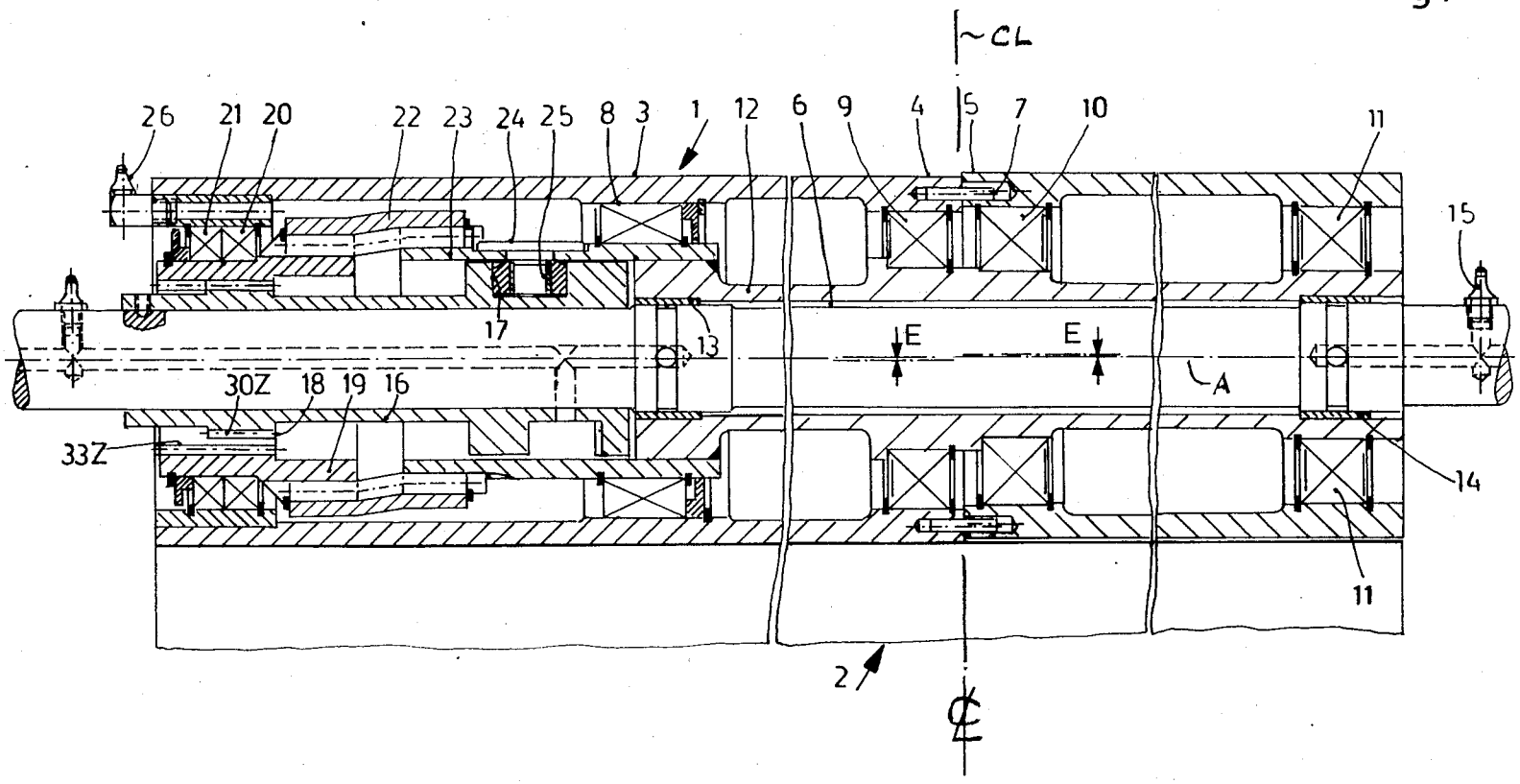
FIG. 1 is a cross-sectional view of an axially oscillating roller showing a first embodiment, and in which the roller is longitudinally or axially cut and compressed, where interior portions are similar to those shown.
Figure 2:
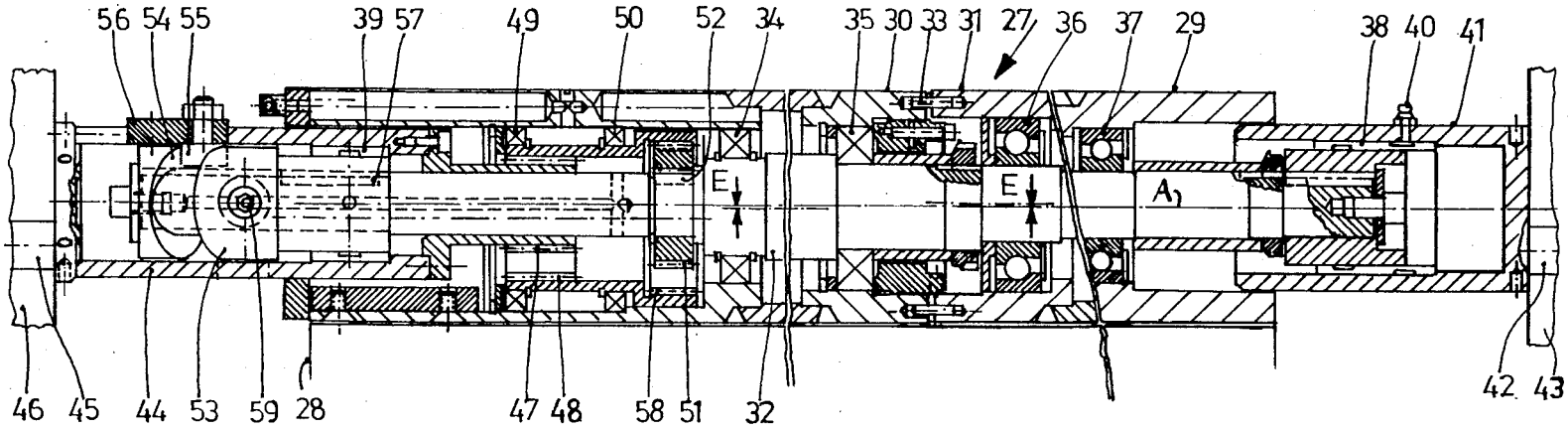
FIG. 2 is a longitudinal sectional view through another embodiment of an axially shifting roller having eccentric portions.

A roller 1 is held between side walls—not shown in FIG. 1—of a rotary printing machine, in frictional engagement with the surface of another roller 2, shown only schematically. Roller 2 is a liquid-carrying roller, for example a part of an inker of a rotary printing machine, or a part of a damping system. The roller may also have the function of a reactivator and be an ink-damping liquid application roller. Roller 1, not driven circumferentially, receives its rotary drive power from frictional surface engagement with roller 2. Roller 1 is axially oscillating, as will appear. Preferably, a plurality of rollers 1 are engageable with, or engaged with roller 2, particularly if roller 2 is an inker roller or an ink application roller. The phases of the axial shift or oscillation of respectively different rider rollers 1 should be so arranged that sequential rider rollers 1, in any region, engage roller 2 axially when the preceding rider roller is free, in the same region, from engagement with roller 2, and oscillates in opposite direction, in an idle reverse stroke. Thus, continuously effective frictional and milling components acting to move liquid on the roller 2 will be maintained. This arrangement essentially suppresses striping effects due to differences in ink films on the roller 2. The roller 2 is shown in FIG. 1 only schematically. FIG. 1 also shows the center line or central position of roller 2; it should be noted that the illustration of FIG. 2 is axially compressed by cutting the representation of the rollers 1, 2 in regions where a specific description is not needed.

In accordance with a feature of the invention, the rider or liquid-distributing roller 1 has at least two axial portions or parts which, preferably, have the same axial length. In accordance with the invention, only that one of the surface parts or components of roller 1 will have engagement contact with the liquid application roller 2 which carries out a movement in axial direction towards the center line CL of roller 2. That part of the roller 1 which moves towards the outside, upon the axial stroke, is lifted off the roller 2, so as to be in idling position. This arrangement thus, provides for movement or shifting of excess liquid, such as ink, emulsion, and/or damping liquid, from the outer or terminal or end regions of the rollers towards the center, shown schematically by center line 2. At the same time, no ink transport is effected by the axially oscillating roller from the center line CL towards a terminal end of the rollers since that portion or part of the rider or idler or transport roller 1 will be out of contact or out of engagement with the roller 2.

Roller 1, as shown in FIG. 1, is driven by frictional engagement with the liquid carrying roller 2. The jacket 3 of the roller 1 is divided into two cylindrical sections or portions which are eccentrically located with respect to each other, thereby forming two sections 4, 5, fitted against each other at the center of the roller 1. The eccentricity E, in a typical embodiment of a rider or idler roller for a printing machine inker is, for example, about 0.15 mm. The jacket or surface 3, and hence the halves or portions 4, 5 of the jacket surround a fixed shaft 6. Connecting pins 7, forming the equivalent of a claw clutch, provide for drive between the halves 4, 5 of the jacket. This connection is necessary since only one half of the jacket 3 is in engagement with the liquid carrying roller 2. In the embodiment shown, the half 4 is in engagement with the roller 2, the half 5 being spaced from the roller 2 and, therefore, with respect to the roller 2, being in idling position. Upon further rotation, and consequent axial shift or oscillation, that is, translatory shift of roller 1 towards the right, the limit of movement towards the right will be reached and, at that time, the portion 4 will, due to the eccentric arrangement, be lifted off engagement with the roller 2 so that, upon return movement towards the left, the portion 5 will come into engagement with the roller 2 and move liquid thereon from the right side towards the center. The engagement pins 7 which couple the halves 4, 5 together will continue to rotate the portion 4, although portion 4 is out of engagement with the roller 2 upon the return stroke towards the left—with respect to FIG. 1.

The jacket 4 is supported by bearings 8 and 9 on a tubular element 12, located over the fixed shaft 6. The jacket 5 is likewise supported by bearings 10, 11 on the tubular element 12. The tubular element 12 is rotatable with respect to the fixed shaft 6, by being rotatable via sleeves 13, 14. Sleeves 13, 14 may have substantial axial extent. Lubricating ducts and nipples are coupled to the sleeves 14 which, for example, may be bronze bearings. Lubrication, throughout the apparatus, can be obtained in accordance with usual engineering practice.

A circular control cam 16 is non-rotatably secured to the shaft 6. The rotary cam element 16 has a cam track 17 thereon, which defines the axial oscillatory movement of the roller 1. The cam element 16 is coupled to a gear 18 having external gearing which, in the example selected, has thirty teeth. An internally geared gear 19 is located, eccentrically, about the gear 18. The engagement of the internally geared gear 19 is such that it engages gear 18 only on one circumferential position, in dependence on the rotary position of the respective gears. Gear 19 has a larger number of teeth, in the example thirty-three teeth. The internally geared, eccentrically located gear, forming a gear ring 19, is located within the jacket 3, and, specifically, in the half or portion of the surface jacket 4 of the roller 1. The eccentric arrangement of the internally geared gear or ring 19 over the concentrically—with respect to the axis 6—located externally geared gear 18, and the difference in gear teeth number, results in rotation of the gear 19 upon rotation of the roller 1, however with a suitably stepped-down speed. The stepped-down speed is computed as follows:

$$(33-30):3=1:11 \qquad (1).$$

The slower rotary movement, by a factor of 11, is transmitted via a flexible coupling 22, with an intermediate element 24, to the cam follower roller 25 which rotates within the fixed cam track 17 in the circular cam 16. The eccentric offset of gear 19 is compensated by the flexible coupling 22 which may, for example, be a flexible hose or an inner-geared flexible element, such as a gear belt. The elements which require compensation, which are, again, centrally or concentrically located, are the curve roller 25 which is secured to a curve roller carrier 23, concentric with respect to the shaft 6. The curve roller carrier 23 is coupled at the right side thereof with the tubular element 12; the connection may, for example, be by welding.

OPERATION

Upon frictional engagement of the jacket parts 4 or 5 of the jacket 3 with the fluid film roller 2, the cam roller carrier 23 and the tubular element 12 will be driven with the stepped-down speed in accordance with the above-described apparatus, and will, simultaneously with rotation, carry out an axial oscillation controlled by the cam track 17 within which the cam roller 25 operates. Bearings 8 to 11 force the halves 4, 5 to oscillate axially while rotating. The axial oscillation is assisted by lubrication 15, 26. The lubricating nipple 26 provides for additional assistance in the lateral sliding by providing additional lubricant.

The arrangement of the halves 4, 5 of the jacket, connected together as described, results in that both halves 4, 5 are continuously rotated by frictional engagement of one of them with the roller 2, independently of the phase or instantaneous position of the halves during the axial oscillating stroke. The cam track 17 is so secured to the shaft 6 that, with respect to the eccentric offset E of, preferably, 180° of the halves 4, 5 of the jacket with respect to each other, the axial drive applied to the roller 1 will bring into engagement with the roller 2 always that portion or half 4 or 5 of the jacket 3, in engagement with the roller 2, which is at that time moving from the outer regions of the roller 2 towards the center line CL, so that any fluid or liquid on the roller 2 will be pushed or transported towards the center of the roller 2. That portion of the jacket 3, which is moving towards the outer region of the roller 2, is then lifted off contact with the roller 2, so that, in contrast to the generally known principle of oscillating milling rollers in continuous engagement with another roller, no liquid is pushed from the central region, as indicated by the center line CL, towards the outside. The eccentricity E is relative to axis A of roller 2.

The arrangement with the idler roller 2 is particularly suitable for ink application rollers within an ink train; it may be used, however, in connection with any ink roller within an inker, preferably a roller which is close to the plate which is to be inked. Generally, the liquid which is to be transported towards the central region need not be ink, but may, for example, be an emulsion of ink and damping liquid, or of damping liquid alone; the nature of the fluid being transported from the end regions on the roller 2 towards the central region is independent of the inventive concept.

Embodiment of FIG. 2: The arrangement of FIG. 2 has the same effect as that of FIG. 1 without, however, requiring the flexible coupling to compensate for the eccentric offset of the gears.

The idler roller 27 is in engagement with a fluid film roller, preferably an ink application roller 28. Roller 28 is shown only only in fragmentary and highly schematic form. The idler roller 27 has a jacket 29 which includes two jacket halves 30, 31. The jackets 30, 31 are eccentric with respect to each other, preferably offset by 180°, and are connected by connection pins 33, so that a drive torque can be transmitted between the halves 30, 31 of the jacket 29.

The jacket 29, or, rather, the jacket halves 30, 31, are located on a shaft 32 which rotates with a step-down ratio—with respect to the rotary speed of the film roller 28—and which is additionally used to transmit the axial oscillation movement. Bearings 34, 35, 36, 37 provide for rotary coupling. The two ends of the shaft 32 are laterally secured in side walls 43, 46. The ends of the shaft 32 are retained in bushings 38, 39, each furnished with a lubricating arrangement 40—of which only one is shown—the bushings being retained in tubular protrusions 41 securely retained in side wall 43 by a pin 42. The left side is similarly arranged, with a pin 45 retaining a tubular protrusion or pipe 45 thereon for, in turn, retaining the sleeve 39.

A gear wheel 47, with externally placed gear teeth, is non-rotatably secured to the pipe or protrusion element 44. A pair of inwardly geared gear rings 48, 58 is in engagement with the gear 47. Functionally, gear 47 corresponds to the gear 18 (FIG. 1) and the eccentrically engaging gear 48 corresponds to the gear 19 (FIG. 1). Rather than using the flexible coupling 22, however, a further gear 51 is concentrically and non-rotatably secured on the shaft 32 which, likewise, is in engagement with the gear 58. Gear 58 is rotatably retained in bearings 49, 50 within the jacket portion 30. In the example selected, gear 47 has twenty-three teeth; the inner gear ring 48 has thirty teeth, and the inner gear ring 58 has thirty-eight teeth. Gear 51 has thirty-one teeth. The eccentricity and the number of teeth must be relatively considered so that engagement, with meshing of gear teeth, and loss of engagement of gear teeth of the three gears 47, 51 and one of the pairs 48, 58 will reliably and smoothly occur. In the present example, use of the gears 47, 48, 51, 58 will result in the following gear ratio:

$$i = \frac{(30 - 23)(38 - 30)}{30 \cdot 31} = 1{:}16.607. \quad (2)$$

Consequently, the gear 51, and hence the shaft 32 secured to the gear 51, will rotate with a step-down ratio. As shown, gear 51 can be non-rotatably coupled to the shaft 32 by a spline or spline-spring, respectively.

A cam track carrier 53, in tubular form, is non-rotatably secured on the shaft 32, carrying a cam 54 which is engaged by a cam follower roller 55 coupled by a coupling element 56 with the fixed tube or pipe element 44. Due to the aforementioned rotation of the shaft 32, the cam track carrier 53 is rotated, so that the shaft 32 will be axially oscillated by engagement of the cam track 54 with the cam follower roller 55. This axial oscillation is transmitted via the bearings 34, 35, 36, 37 to the jacket 29, or, more precisely, to the portions 30, 31 of the jacket 29. As described above, the follower pins 33 insure that the jacket 29 is always rotated by frictional engagement with the film roller 28, independently of the particular half or portion 30, 31 which is then in engagement with the film roller 28.

A spring 57 securely connects the cam carrier 53 with the shaft 32. To insure smooth running, a lubricating system 59 is used.

The movement of ink or other fluid from the outer or end regions of the fluid or film roller 28 towards its center is carried out in the same way as in the embodiment of FIG. 1. As the idler roller 27 rotates and shifts axially, that one of the portions of the idler roller which carries out a movement from an end region of the roller 28 towards the center will be in engagement with the surface of the roller 28, and, as the axial oscillatory movement of the roller 27 reverses, which would move that first portion towards an end region, it is eccentrically lifted off engagement with the roller 28, and the other part or half of the jacket is engaged since that other part, then, will move from the other end portion of roller 28 towards its center region. The method of shifting liquid towards the center, thus, is the same.

Figure 3:
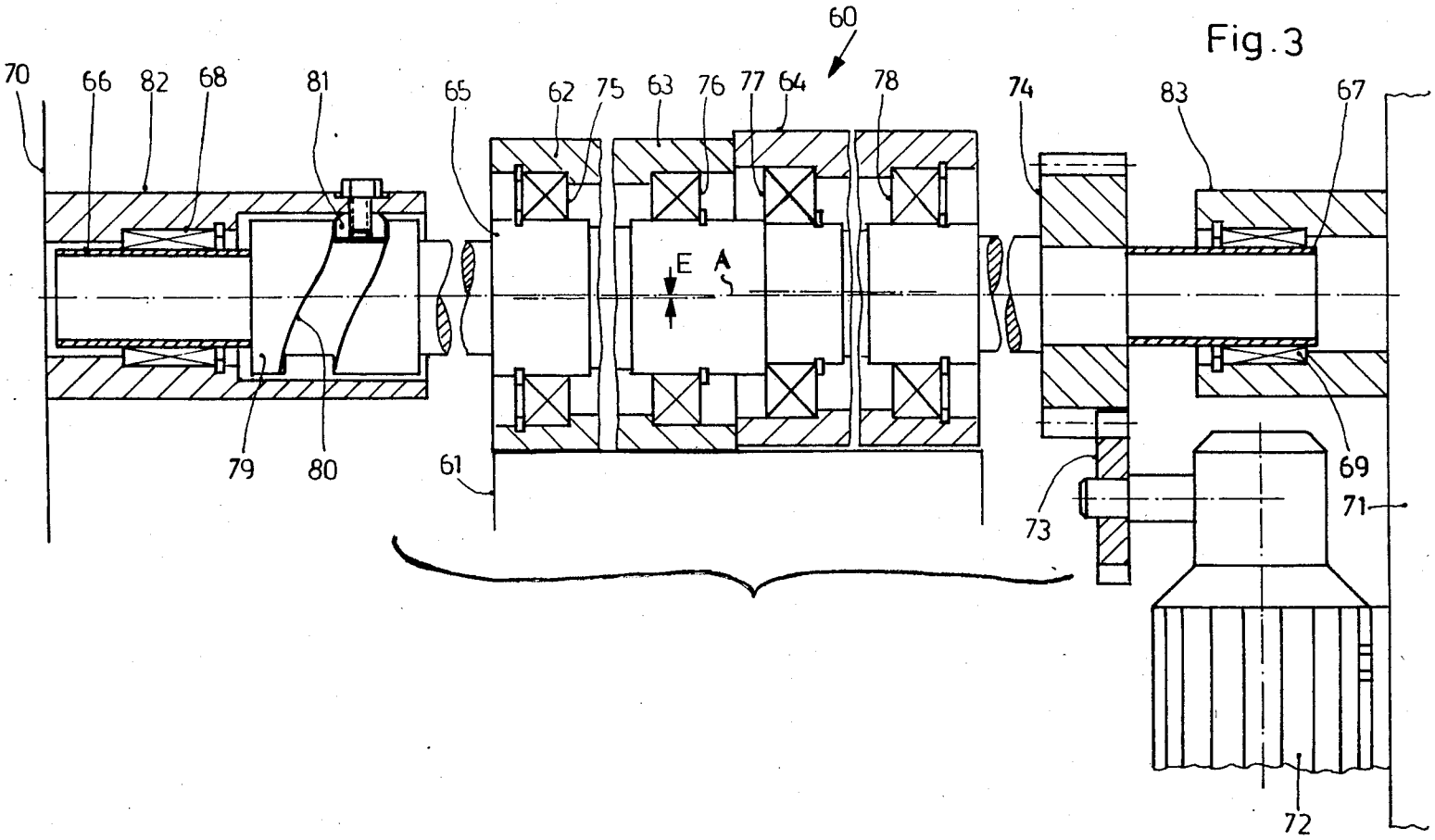
FIG. 3 illustrates, schematically, another embodiment in which the axial oscillating movement is controlled by a fixed camming arrangement.

The embodiment of FIG. 3 illustrates a particularly simple arrangement which, however, requires a separate drive. Such a separate drive can be obtained independently by a motor, or by gearing or other rotary transmission from the printing machine itself, for example derived from an external gear driving the film or fluid carrying roller.

The roller 60, which is a rider corresponding to rollers 1 and 27 (FIGS. 1 and 2) is engageable with the film or fluid-carrying roller 61. Roller 61, again, may carry any fluid, but, preferably,.is an ink application roller, for example applying ink to a plate cylinder of a rotary printing machine or to another ink transport roller in an inker roller train. The rider roller 60 has a rotary jacket 62 including two eccentrically offset jacket halves 63, 64. The phase of eccentric offset, with respect to each other, preferably again is 180°. In contrast to the embodiments of FIGS. 1 and 2, the jacket halves 63, 64 need not be coupled together for conjoint drive since a separate drive 65 via the shaft of the roller is provided.

Shaft 65 is formed with axially elongated end portions or rings 66, 67 which are located in needle bearings held within side walls 70, 71 of the machine.

A drive arrangement for the shaft is provided by gears 73, 74, gear 74 being non-rotatably secured to the shaft 65. Shaft 65, thus, can rotate within the bearings 68, 69. The jacket 62, or, rather, the respectively eccentrically arranged jacket portions or halves 63, 64, can rotate about the shaft 65, being rotatably retained on the shaft 65 by respective bearings 75, 76, 77, 78. A control cam carrier 79 with a cam track 80 is located on one side of the shaft 65—as shown on the left side—and non-rotatably secured to the shaft 65. The cam track 80 is engaged by a non-rotatably secured cam track follower roller 81, attached to a fixed sleeve element 82 which can be used at the same time to retain the needle bearing 68. The needle bearing 69 is retained in a similar, but shorter tubular element 83. The tubular elements 82, 83 are secured to the side walls 70, 71, respectively.

The gearing 73, as shown, is driven by an external motor 72. The gearing may, of course, also be driven directly from the printing machine.

OPERATION

Upon drive of the shaft 65, the shaft 65 will oscillate axially due to the engagement of the cam roller 81 in the cam track 80 of the cam 79. The roller jackets will, again, be in frictional engagement with the film or liquid-carrying roller 61, so that the respective roller halves 63, 64, besides oscillating axially, will additionally be rotatably driven by frictional engagement with the film carrying roller 61, the respective halves engaging the roller 61 each time when the axial oscillatory movement of the respective half of the jacket which is in engagement with the roller 61 is from an end portion towards the center. The jacket halves 63, 64, thus, will rotate as well as move axially and, additionally, will be in engagement with the roller 61 only during that period of time when the oscillatory movement is from an end region of the roller 61 towards the center.

The circumferential position and the cam track 80 of the cam 79, with respect to the shaft 65, must be so selected that always that half of the jacket, in FIG. 3 the portion 63, moves towards the center region of the film or liquid-carrying roller 61 when the respective portion is engagement with the roller 61. At the same instant of time, the other portion or half of the jacket, that is, in the example shown the portion 64, is lifted off or clear from the liquid-carrying roller 61, since, at that instant of time, the portion 64 will move towards the right end region of the roller 61.

All three examples, thus, carry out the same method and are subject to the same principle as explained in connection with FIGS. 1 and 2. Various other arrangements, thus, can be made to axially oscillate a roller of which only those portions of the roller surface are in engagement with a film-carrying roller which move from an end region towards a center region.

The shafts 32 (FIG. 2) and 65 (FIG. 3) as well as the tubular element 12 (FIG. 1) can generate not only the axially oscillating movement but also form the rotary eccenter drive for eccentricity E. This will insure synchronism between the two movements, so that the film or liquid distribution will always be towards the center of the film or liquid-carrying roller, regardless of possible slippage due to frictional engagement between the oscillating roller and the film or liquid-carrying roller.

The arrangements to generate the oscillating movement may be used also without the combination of the double-eccentric shaft and the separated halves of the oscillating roller. The result, then, will be a frictionally driven, axially oscillating rider or idler roller with the known effect of the prior art which, however, with respect to previously known drives, has this advantage: Single-step drives, as known in the prior art, in the past required a flexible coupling or a coupling which was engaged with suitable drive surfaces so that the eccentrically generated drive movement will be centrally with respect to the shaft. The two-step arrangement shown in FIG. 2 eliminates such a separate coupling. By elimination of this separate coupling, the eccentricity between the externally geared gear and the internally geared gear ring can be relatively large, thus resulting in smooth interengagement of the gears upon initial engagement, meshing, and run-out. The gearing can thus be so arranged that a high torque can be transferred by providing a large number of teeth.

Various other changes and modifications may be made, and features described in connection with any one of the embodiments may be used with any of the others, within the scope of the inventive concept.

I claim:

1. In a liquid handling system having a counter roller (2, 28, 61) carrying a film of liquid;

means for transporting the film of liquid axially along the counter roller, comprising a rider roller (1, 27, 60) having a center axis (A);

an essentially cylindrical outer jacket (3, 29, 62), said outer jacket comprising at least two jacket portions (4, 5; 30, 31; 63, 64) which are eccentric with respect to the axis (A) of the rider roller and angularly eccentrically offset with respect to each other;

means (17, 25; 54, 55; 79, 80) for axially reciprocatively oscillating the jacket portions, resulting in axial oscillatory reciprocating movement of the rider roller;

and means (70, 71) for locating the axis (A) of the rider roller with respect to the circumference of the counter roller to place one of the eccentric portions of the rider roller in surface contact with the surface of the counter roller, wherein the rider roller is rotated, and the rotation of the rider roller and axial oscillation of the reciprocating movement of the rider roller are so synchronized that the one of the eccentric jacket portions which is in contact with, and rolls off the circumference of, the counter roller, is axially moved in a direction from a first portion of the counter roller towards its axial centerline and, upon reversal of reciprocating movement of the rider roller (1, 27, 60), the other eccentric portion is brought into contact with the counter roller to again roll off the circumference of the counter roller while moving axially from the second end portion towards the centerline while the one of the eccentric portions is moving from the centerline of the counter roller towards the first end portion, but out of engagement with the surface of the counter roller, to thereby move liquid on the counter roller from the end portion towards the centerline, and with the circumferential speeds of the rider roller and the counter roller being at least approximately equal.

2. In a printing machine, the liquid handling system as claimed in claim 1, wherein the film of liquid comprises at least one of: printing ink; damping liquid; an emulsion of printing ink and damping liquid.

3. Liquid film transport means according to claim 1, wherein the rider roller (1, 27, 60) is rotated by frictional engagement with the counter roller (2, 28, 61);

and the means for axially oscillating the jacket portions comprises means (18, 19, 22, 23, 24, 25, 17; 47, 48, 51, 53, 54, 55, 58) coupled to the jacket portions and converting rotary movement of the jacket portions into reciprocating translatory movement thereof.

4. Liquid film transport means according to claim 3, wherein the means for converting rotary movement of the jacket portions into axially oscillating reciprocating movement includes a tube (12) surrounding said center axis (A) and being axially slidable with respect to the center axis;

and bearings (8–11) rotatably secured on said tube and axially slidable therewith.

5. Liquid film transport means according to claim 4, wherein the means for converting rotary movement into axially reciprocating movement comprises a gear (18) non-rotatably secured within the rider roller;

an internally geared gear ring (19) eccentrically positioned with respect to said gear (18) and having a larger number of teeth than said gear (18);

bearings (20, 21) retaining said gear ring (19) within one (4) of the jacket portions (4, 5);

a cam-and-cam follower arrangement including two interengaging elements, one of said elements being secured, non-rotatably, within said idler roller;

a flexible coupling (22) connecting the other one of said elements with said gear ring (19), the cam-and-cam follower arrangement having a cam track (17) which has an axial component portion to thereby cause, upon rotation of the respective jacket portion (4, 5) axial movement thereof;

and a rotation-transmitting coupling (7) rotatably connecting together said jacket portions.

6. Liquid film transport means according to claim 5, including a non-rotatable central shaft (6);

said non-rotatable gear (18) being secured to said shaft (6) and having thirty teeth;

and wherein the inner geared gear ring (19) has thirty-three teeth.

7. Liquid film transport means according to claim 1, wherein (FIGS. 1 and 2) interengaging coupling means (7) are provided coupling together the jacket portions (4, 5; 30, 31) for conjoint axial and rotary movement.

8. Liquid film transport means according to claim 1, including support elements (12, 32, 65) forming support means and supporting both said jacket portions, and carrying the means for axially oscillating the jacket portions as well as rotating in synchronism with the rotation of the jacket portions to simultaneously and synchronously provide for rotation and axial oscillation for synchronous engagement of that one of the jacket portions which, upon axial reciprocating movement, is movable from an end portion of the counter roller towards the center thereof.

9. Liquid film transport means according to claim 1, wherein the eccentricity of the respective jacket portions with respect to the central axis (A) is about 0.1 mm.

10. Apparatus, for axially moving a rider or idler roller (1) with respect to a counter roller (2) by frictional engagement of at least a portion of the circumference of the rider roller on at least a portion of the circumference of the counter roller, comprising a tube (12) surrounding the center axis (A) of the rider or idler roller (1), and being axially slidable with respect to the center axis (A);

bearings (18-11) rotatably secured on said tube and axially slidable therewith;

a gear (18) non-rotatably secured within the rider roller;

an internally geared ring (19) eccentrically positioned with respect to said gear (19) and having a larger number of teeth than said gear (18);

bearings (20, 21) retaining said gear ring (19) within a jacket (3) on the rider roller (1, 27);

a cam-and-cam-follower arrangement including two interengaging elements, one of said elements being secured, non-rotatably, within said idler roller; and coupling means (22) connecting the other one of said elements with said gear ring (19), the cam-and-cam-follower arrangement having a cam track (17) which has an axial component portion to thereby cause, upon rotation of the jacket (3), axial movement thereof.

11. Apparatus according to claim 10, including a non-rotatable, central shaft (6);

said non-rotatable gear (18) being secured to said shaft (6) and having thirty teeth;

and wherein the inner geared gear ring (19) has thirty-three teeth.

* * * * *